US007127996B2

(12) United States Patent
Muth

(10) Patent No.: US 7,127,996 B2
(45) Date of Patent: Oct. 31, 2006

(54) DIMPLED PROJECTILE FOR USE IN FIREARMS

(76) Inventor: Karl Muth, 61 W. 15th, Chicago, IL (US) 60605

( * ) Notice: Subject to any disclaimer, the term of this patent is extended or adjusted under 35 U.S.C. 154(b) by 37 days.

(21) Appl. No.: 10/886,471

(22) Filed: Jul. 6, 2004

(65) Prior Publication Data

US 2006/0005731 A1 Jan. 12, 2006

(51) Int. Cl.
*F42B 12/78* (2006.01)

(52) U.S. Cl. ..... 102/516; 102/517

(58) Field of Classification Search ..... 102/507, 102/508, 506, 517, 518, 514, 515, 516
See application file for complete search history.

(56) References Cited

U.S. PATENT DOCUMENTS

| | | | | | |
|---|---|---|---|---|---|
| 1,077,607 | A | * | 11/1913 | Johnson | 102/507 |
| 1,099,298 | A | * | 6/1914 | Hoagland | 102/507 |
| 1,149,679 | A | | 10/1915 | Parker | 244/3.1 |
| 2,861,810 | A | * | 11/1958 | Veatch | 473/353 |
| 3,349,711 | A | * | 10/1967 | Darigo et al. | 102/509 |
| 4,142,727 | A | | 3/1979 | Shaw et al. | 273/232 |
| 4,164,904 | A | | 8/1979 | Laviolette | 102/92.7 |
| 4,301,736 | A | | 11/1981 | Flatau et al. | 102/503 |
| 4,560,168 | A | | 12/1985 | Aoyama | 273/232 |
| 5,092,246 | A | | 3/1992 | Huerta | 102/439 |
| 5,106,096 | A | | 4/1992 | Dunn | 273/232 |
| 5,200,573 | A | | 4/1993 | Blood | 102/501 |
| 5,621,186 | A | * | 4/1997 | Carter | 102/507 |
| 6,165,564 | A | * | 12/2000 | Crast et al. | 427/517 |
| 6,299,550 | B1 | * | 10/2001 | Molitor et al. | 473/354 |
| 6,393,992 | B1 | * | 5/2002 | Vasel et al. | 102/502 |
| 6,694,888 | B1 | | 2/2004 | Jopson et al. | 102/506 |
| 6,705,959 | B1 | | 3/2004 | Morgan et al. | 473/383 |
| 6,706,332 | B1 | | 3/2004 | Lutz et al. | 427/461 |
| 2001/0045173 | A1 | * | 11/2001 | Gibson et al. | 102/513 |
| 2001/0048180 | A1 | * | 12/2001 | Cupples | 264/275 |
| 2003/0101891 | A1 | * | 6/2003 | Amick | 102/514 |

* cited by examiner

*Primary Examiner*—Stephen M. Johnson
(74) *Attorney, Agent, or Firm*—Winston & Strawn LLP

(57) ABSTRACT

A projectile for use in firearms and of the type having on one end a hemispherical tip which communicates at its base with a nose segment which then attaches to a cylindrical body terminating in a surface whose width represents the diameter of the aforementioned cylindrical body. One or many parts of the projectile are coated or plated in a material that creates a surface featuring recesses when it hardens. This surface acts as an aerodynamic aid when the projectile is in flight. The coating or plating may be applied directly to the projectile or layered on top of a jacket.

18 Claims, 2 Drawing Sheets

DIMPLED PROJECTILE FOR USE IN FIREARMS

BACKGROUND

1. Field of Invention

This invention relates to projectiles with hemispherical points that are used in firearms.

2. Description of Prior Art

Revolvers, semi-automatic pistols, automatic machine pistols, submachine guns, small arms using caseless ammunition, shotguns using slugs, penetrating warheads, mortars, missiles, field artillery, and other weapons utilize ammunition with a hemispherical tip profile.

In 1861, when the first centerfire cartridge was patented in England, the projectile's tip profile was essentially hemispherical. In the nearly 150 subsequent years, many attempts have been made to stabilize bullets that have a hemispherical forward profile. With the invention of the jacketed firearms projectile in 1875 and the more recent efforts at balanced projectile loads, the accuracy of hemispherical tip profile ammunition improved.

Still, the two major problems of lack of accuracy and loss of velocity due to turbulence with hemispherical tip profile ammunition have been only partially solved. Hemispherical tip profile ammunition historically underperforms rifle or pointed ammunition due to its aerodynamic inferiority. A typical hemispherical projectile is shown in FIG. 1.

Several patents deal with the use of recessed regions or "dimples" to aid aerodynamic characteristics of projectiles and increase the sustained velocity or accuracy of a projectile object, notably U.S. Pat. No. 4,142,727 to Shaw et al. (1979), U.S. Pat. No. 4,560,168 to Aoyama (1985), and U.S. Pat. No. 5,106,096 to Dunn (1992). Dimples or recessed regions that are numerous and arranged in very specific geometric patterns are discussed in U.S. Pat. No. 6,705,959 to Morgan, et al. (2004). U.S. Pat. No. 6,706,332 to Lutz, et al. discusses methods such as those including using recessed regions to enhance aerodynamic performance of a projectile and then coating regions of the projectile in order to further enhance aerodynamic performance. Recessed regions or dimples in the leading surfaces of a projectile are separate and significantly different in design from voids enclosed within the projectile's body, such as are described in U.S. Pat. No. 6,694,888 to Jopson and Davis (2004) and others. Of course, these patents have adapted their teachings to the specific products disclosed therein.

Many types of ammunition that may improve the aerodynamics of small arms munitions through recessed regions have been proposed, for example, in U.S. Pat. No. 1,149,679 to Parker (1915), U.S. Pat. No. 4,164,904 to Laviolette (1979), and U.S. Pat. No. 4,301,736 to Flatau et al. (1981), but these tend to focus on the concept of one or a small number of deeply recessed regions that make the projectile essentially hollow as a method for reducing aerodynamic resistance. Many patents which do not propose a hollow projectile still often focus on a single deep cavity such as is disclosed in U.S. Pat. No. 5,092,246 to Huerta (1992). U.S. Pat. No. 5,200,573 to Blood (1993) refers to firearm projectiles but also refers to machining cavities into the mold used to cast the projectile and to rolling, swaging, or stamping cavities into the surface of the projectile, all of which offer opportunities for damage to the projectile surface during the manufacturing process.

All the methods heretofore known for significantly increasing the aerodynamic efficiency of hemispherical tip profile projectiles suffer from one or more of a number of disadvantages:

(a) Their manufacture involves casting, rolling, swaging, stamping, forming, forging, or machining processes requiring an ejection or release that presents an opportunity to damage the hemispherical tip surface of the projectile when it is removed from the manufacturing process, a situation that allows for significant aerodynamic differences between two similarly-produced projectiles.

(b) Their retention of a projectile's velocity customarily must be sacrificed in order to achieve improved aerodynamic stability and accuracy, or their stability and accuracy must be sacrificed in order to achieve improved velocity.

(c) Their manufacture is complex, often requiring hand finishing or complex methods to achieve a hollow or significantly hollow projectile through which a significant amount of air can pass undisturbed—these methods are not easily adapted to assembly-line manufacturing.

(d) If one uses a hollow or essentially hollow projectile in a near-sonic or supersonic application, the pressures within the hollow or essentially hollow projectile are likely to significantly disturb the projectile's flight, harm its accuracy, and jeopardize its velocity retention.

(e) They generally offer poor performance across a range of speeds, optimizing the design's aerodynamics around a small range of the speeds a projectile might encounter while experiencing only either supersonic or subsonic flight.

(f) Projectiles with improved aerodynamics generally are easily distinguished from regular munitions in terms of appearance or physical characteristics, making their use in place of regular munitions potentially difficult if accessories, magazines, extractors, and other firearm-related items are not designed with a particular type of aerodynamically-improved projectile in mind.

(g) Their manufacture often involves special casings or special "brass" designs that are not interchangeable with regular munitions of the same caliber.

(h) Ammunition designed with aerodynamic advantages often does not lend itself to backward-compatibility with earlier firearms designs including revolvers, pistols, machine pistols, and other firearms—many designs, though they may offer aerodynamic advantages, are sufficiently different in shape or mass to cause feed malfunctions or failure-to-fire malfunctions in firearms not designed with the peculiarities of the particular ammunition in mind.

(i) The use of lead and other substances of measurable toxicity in the manufacture of either cores or jackets of ammunition poses potential environmental and health risks.

Thus, improvements in the aerodynamic performance of ammunition, missiles and similar projectiles are desired, and these are now provided by the present invention.

SUMMARY OF THE INVENTION

The invention relates to a munitions projectile comprising a forward portion that presents an exterior surface that has a conical or hemispherical shape, and added material provided in a pattern of raised surface area portions on the exterior surface to provide improved aerodynamic properties to the projectile compared to munition projectiles that do not include such added material.

Preferably, the added material is provided as a coating or plating on the exterior surface of the projectile. The pattern of the added material advantageously defines a plurality of uncoated or unplated portions that appear to be recesses, with the recesses preferably appearing in the shape of concave dimples.

The added material is typically provided at a thickness of between about 0.001 and 0.005 in. When the exterior surface of the projectile is made of a metal or alloy, the coating or plating can also be made of a metal or alloy.

In one embodiment, the projectile has a nose portion wherein the exterior surface forms part of the nose portion. Alternatively, the projectile can have a nose portion that is covered by a jacket, wherein the exterior surface forms part of the jacket. Generally, the projectile has a hemispherical tip and a rearward cylindrical portion.

The invention also relates to a method for enhancing aerodynamic properties of a munitions projectile that includes a forward portion that presents an exterior surface that has a conical or hemispherical shape, which method comprises adding material in a pattern of raised surface area portions on the exterior surface to provide improved aerodynamic properties to the projectile compared to munition projectiles that do not include such added material.

BRIEF DESCRIPTION OF THE DRAWING FIGURES

DETAILED DESCRIPTION OF THE PREFERRED EMBODIMENTS

In accordance with the present invention a projectile comprises a generally cylindrical object having a tapered nose segment featuring a hemispherical tip and a surface covered in recesses created through coating or plating.

Several advantages of the present invention include:

(a) to provide a projectile whose hemispherical tip or nose section is finally affected by coating or plating instead of impact with an extractor or release pin device that might damage or alter the aerodynamic properties of the surface of the product;

(b) to provide a projectile which has improved aerodynamic stability as well as improved retention of velocity without sacrificing, in any significant measure, one in order to improve the other;

(c) to provide a projectile which can be produced with simple methods and little or no hand finishing;

(d) to provide a projectile which can function properly and give superior aerodynamic performance at subsonic, near-sonic, and supersonic velocities;

(e) to provide a projectile which is optimized around no specific set of velocity parameters that has excellent aerodynamic capabilities at any applicable velocity;

(f) to provide a projectile which is completely interchangeable with regular munitions of a similar cartridge and caliber that can be used in place of regular munitions without fear of incompatibility or malfunction;

(g) to provide a projectile which has improved aerodynamic stability and improved retention of velocity which can still use standard casings or standard "brass"—in other words, to provide a projectile which may be used with brass from regular munitions and into whose brass regular munitions may be packaged;

(h) to provide a projectile which offers advanced aerodynamics while retaining backward-compatibility with earlier device designs including revolvers, pistols, machine pistols, and other firearms;

(i) to provide a projectile which can have advanced flight characteristics while being principally manufactured from environmentally-responsible materials.

Further advantages are to provide a projectile which can be used easily and conveniently in place of regular munitions, which requires little or no additional training for a user already familiar with the firearm in question and its usual munitions, which is simple to use and inexpensive to manufacture, which provides additional velocity retention performance and accuracy across a variety of calibers, which obviates the need to significantly change ammunition manufacturing facilities or significantly change the design of firearms in order to create usable ammunition in commonly-available calibers with significantly increased velocity retention and accuracy. Still further advantages will become apparent from a consideration of the ensuing description and drawings.

Figure 2:
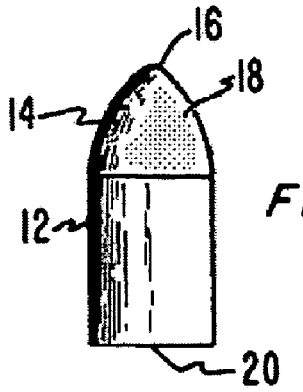
FIG. 2 shows a projectile of the invention that is not jacketed but instead coated or plated across the hemispherical tip and nose segment by a material that provides surface recesses.

A typical embodiment of the projectile of the present invention is illustrated in FIG. 2. The projectile has a hemispherical tip 16 which represents the forwardmost part of its tapered nose segment 14. The nose segment, at the point where it ceases to be tapered and adopts a uniform diameter, joins the cylindrical body 12. The termination of the cylindrical body in a surface roughly perpendicular to the primary axis of the cylinder results in a rearward surface of projectile 20. Parts of the projectile may or may not, at this stage, be enclosed in a jacket 10, after which the hemispherical tip 16 and nose segment 14 are covered with a surface featuring recesses 18, such as nickel-heavy chrome plating applied in 3/1000" thickness. In the preferred embodiment, the hemispherical tip 16, nose segment 14, cylindrical body 12, and rearward surface of projectile 20 are formed together in a single casting from a material such as copper, after which the surface featuring recesses 18 is applied. However, the basic projectile can consist of any other material that can be considered environmentally-friendly or environmentally-neutral and can be shaped for use in high-speed projectile applications without fracturing, such as tungsten alloys, types of steel, iron, brass, bronze, etc. Note that materials that are not environmentally-friendly may also be appropriate for the application, including beryllium copper and depleted uranium. So long as allowances are made for the thickness of the surface featuring recesses 18, the jacket 10 may be of any corresponding thickness, though it is not a required component for the present invention to function properly.

The rearward surface of projectile 20 typically varies in diameter according to the cartridge requirements of a given caliber of weapon and typically has an overall diameter of less than the sum of the length of the nose segment 14 and the length of the cylindrical body 12.

Figure 1:
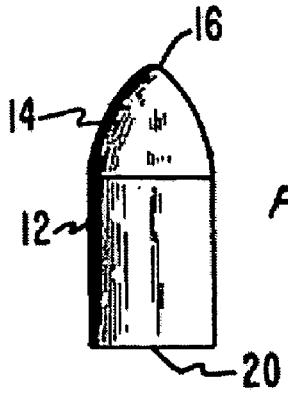
FIG. 1 PRIOR ART
FIG. 1 illustrates a typical projectile with a hemispherical tip and a cylindrical body without a jacket.

A hemispherical tip 16, nose segment 14, cylindrical body 12, and rearward surface of projectile 20, once formed into one object as is customary and shown in FIG. 1, may have its hemispherical tip 16 and nose segment 14 treated with a chroming or plating process involving a material that creates a surface featuring recesses 18. The object in FIG. 1, having undergone the aforementioned process and having received surface featuring recesses 18, becomes the object in FIG. 2 which is consistent with a typical embodiment of the present invention as described herein.

Figure 3:
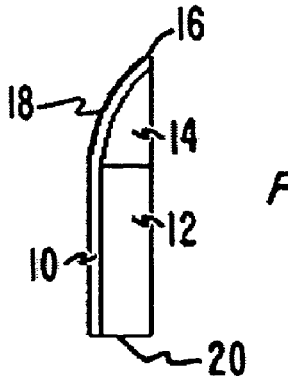
FIG. 3 shows a projectile of the invention jacketed and then coated or plated by a material that provides surface recesses.
Figure 4:
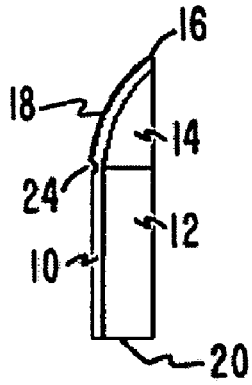
FIG. 4 shows a projectile of the invention jacketed and then coated or plated only across the hemispherical tip and nose segment by a material that provides surface recesses.

Additional embodiments are shown in FIGS. 3 and 4 in cutaway profile views. The projectiles in FIGS. 3 and 4 both feature a jacket 10. The projectile in FIG. 3 features a surface featuring recesses 18 applied on top of its jacket 10 which extends to cover its hemispherical tip 16, nose segment 14, and cylindrical body 12. The projectile in FIG. 4 features a surface featuring recesses 18 applied on top of its jacket 10 which extends to cover its hemispherical tip 16 and nose segment 14 but terminates in an edge of coating or plating 24 and hence the surface featuring recesses 18 does not cover the cylindrical body 12. In neither case does the surface featuring recesses 18 cover the rearward surface of projectile 20.

Figure 5:
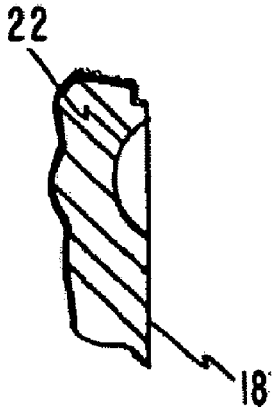
FIG. 5 shows, in profile, a magnification of the type of surface recess created on a surface during the application of certain coating or plating materials, including specifically chrome coatings heavy in nickel applied to a thickness of between about 2/1000" and about 5/1000" depending upon the nickel content of the coating.
Figure 6:
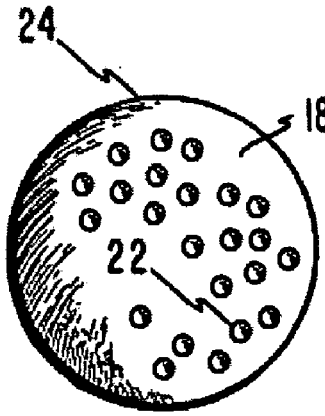
FIG. 6 shows, from a superior view, a magnification of the type of surface recesses created on a surface during the application of certain coating and plating materials, including specifically chrome coatings heavy in nickel applied to a thickness of between about 2/1000" and about 5/1000" depending upon the nickel content of the coating.

In FIG. 5, a magnified profile cutaway of a recess 22 as it might appear in the surface of a surface featuring recesses 18 is illustrated. The recess 22 in FIG. 5 is consistent with phenomena that appear on the surface of thinly coated or plated items. The surface featuring recesses 18 in FIG. 5 is a type of coating or plating. FIG. 6 provides a magnified superior view of the recess 22 frequency and distribution one might see if he or she magnified a portion of the hemispherical tip 16 and nose segment 14 of the present invention as illustrated in FIG. 2 to such a magnification that individual droplets of coating or plating material could be seen as a surface featuring recesses 18.

There are various possibilities with regard to the relative disposition of the areas that are given recesses by being dipped in, or plated with, a material that creates a surface featuring recesses 18 and areas that are not. For example, the pattern can be advantageously provided by coating or plating the exterior surface in any one of a variety of ways. In one embodiment, the pattern can be provided by selectively coating the exterior surface. This can be done directly or indirectly with the latter being accomplishable by masking the exterior surface to provide a mask where the raised areas are not desired, coating or plating the surface and then removing the mask, or by uniformly coating or plating the exterior surface and then removing portions of the coating or plating where raised areas are not desired. Alternatively, the pattern can be provided by providing raised or recessed areas on the exterior surface, followed by uniformly coating or plating all of the exterior surface.

From the description above, a number of advantages of my projectile become evident:

(a) The projectile can be formed using customary processes and later dipped in, or plated with, a material that creates a surface featuring recesses, thus eliminating the tool marks and ejection scars that current processes for texturing the surface of a projectile impart.

(b) The projectile can be used interchangeably with traditional projectiles without need for different parts and without fear of weapons jamming or malfunctioning, thus eliminating inconvenience and confusion among users.

(c) The projectile can be produced in any caliber and utilize essentially the same coating or plating process to impart the required recesses, thus avoiding the cost of machining methods where separate patterns, stamping dies, and machinery must be dedicated to each caliber being produced.

(d) The projectile can be produced from any number of environmentally-neutral or environmentally-friendly materials without significantly affecting its function.

(e) While having a similar appearance to other projectiles of the same caliber, the presence of a layer of material featuring surface recesses will permit the projectile to have stability and velocity-retention performance that significantly exceeds that of conventional ammunition.

The manner of using the projectile in a firearm is identical to that for ammunition in present use. Namely, one first loads the ammunition into a cylinder (in the case of a revolver), into a magazine (in the case of an automatic pistol, a submachine gun, one of many types of rifles, or a magazine-fed shotgun utilizing slugs), into the breech of the firearm (in any device that can be considered a direct-loading or breech-loading firearm), into the feed tube (in a mortar, direct-loading missile system, or shoulder-launched tube-architecture weapon), or into another location on the weapon designed for the loading of unused ammunition. The weapon is then, if necessary, manipulated so as to present the unused ammunition into firing position. Generally, in handheld firearms, the cylindrical body 12 will be parallel to and behind the barrel of the firearm at this point in the procedure. In non-handheld firearms, the projectile may be in a variety of orientations relative to the barrel. The projectile is then launched from the firearm in a way identical to that for projectiles in present use.

Accordingly, the reader will see that the projectile of this invention can be used as a projectile in a variety of firearms easily and conveniently, can be used in place of projectiles in current use, and presents a combination of aerodynamic, manufacturing, and environmental advantages not present in any projectile in current use. In addition to the projectile's ability to maintain the same velocity as ammunition in present use after a farther distance traveled and the projectile's ability to maintain stability in flight longer than ammunition in present use, the projectile of the present invention can be deployed among soldiers, policemen, and civilians who can confidently exploit its superior characteristics with no significant measure of additional training or expertise. Furthermore, the projectile with recessed surfaces has the additional advantages in that it permits the production of improved ammunition in a variety of calibers using similar or identical equipment;

it permits an immediate change in the caliber of the ammunition being produced without requiring any change in tooling or mechanical attributes of the assembly line as it relates to imparting recesses on ammunition;

it eliminates surface damage suffered by current cast ammunition from the ejector or mold release pin by covering this area with a coating or plating process and thus eliminating this type of damage and its aerodynamic effects;

it allows a variety of individuals and agencies to use improved ammunition of the present invention with no additional training or education required;

it allows a variety of individuals and agencies to carry both improved ammunition of the present invention and conventional ammunition with complete interchangeability;

it allows projectiles to travel farther with increased stability, contributing to at-target velocity and accuracy;

it minimizes the environmental impact of firearms discharges.

Although the above description contains many specificities, these should not be construed as limiting the scope of the invention but as merely providing illustrations of some of the presently preferred embodiments of this invention. For example, the projectile can have other shapes, the tapered region of the projectile can have other shapes, the cylindrical body can be produced in more than one part, etc.

Thus the scope of the invention should be determined by the appended claims and their legal equivalents, rather than by the examples given.

What is claimed is:

1. A munitions projectile comprising a forward portion that includes a nose segment, a jacket that surrounds the nose segment and presents an exterior surface that has a conical or hemispherical shape, and added material provided at a thickness of between about 0.001 and 0.005 inch in the form of a metal coating, a metal alloy coating, a metal plating or a metal alloy plating provided on the jacket and which defines a pattern of raised surface area portions predominantly covering the exterior surface of the jacket of the projectile to provide improved aerodynamic properties to the projectile compared to munition projectiles that do not include such added material.

2. The projectile of claim 1, wherein the pattern of the added material defines a plurality of uncoated or unplated portions that appear to be recesses.

3. The projectile of claim 2, wherein the pattern of the added material defines recesses in the shape of concave dimples.

4. The projectile of claim 1, wherein the jacket is made of a metal or alloy.

5. The projectile of claim 1, having a hemispherical tip and a rearward cylindrical portion.

6. The projectile of claim 1, wherein the exterior surface of the jacket is made of a metal or alloy.

7. The projectile of claim 1, having a conical nose segment and jacket and a rearward cylindrical portion.

8. In a munitions projectile that has a forward portion that includes a nose segment, a jacket that surrounds the nose segment and presents an exterior surface that has a conical or hemispherical shape, the improvement comprising added material provided at a thickness of between about 0.001 and 0.005 inch in the form of a metal coating, a metal alloy coating, a metal plating or a metal alloy plating provided on the jacket and provided in a pattern of raised surface area portions predominantly covering the exterior surface of the jacket of the projectile to provide improved aerodynamic properties to the projectile compared to munition projectiles that do not include such added material.

9. The projectile of claim 8, wherein the exterior surface of the jacket is made of a metal or alloy.

10. The projectile of claim 8, having a conical nose segment and jacket and a rearward cylindrical portion.

11. The projectile of claim 8, having a hemispherical tip and a rearward cylindrical portion.

12. A method for enhancing aerodynamic properties of a munitions projectile that includes a forward portion that includes a nose segment, a jacket that surrounds the nose segment and presents an exterior surface that has a conical or hemispherical shape, which method comprises providing added material provided at a thickness of between about 0.001 and 0.005 inch in the form of a metal coating, a metal alloy coating, a metal plating or a metal alloy plating provided on the jacket and in a pattern of raised surface area portions predominantly covering the exterior surface of the jacket of the projectile to provide improved aerodynamic properties to the projectile compared to munition projectiles that do not include such added material.

13. The method of claim 12 wherein the pattern is provided by selectively coating the exterior surface.

14. The method of claim 12 wherein the pattern is provided by masking the exterior surface to provide a mask where the raised areas are not desired, coating or plating the surface and then removing the mask.

15. The method of claim 12 wherein the pattern is provided by uniformly coating or plating the exterior surface and then removing portions of the coating or plating where raised areas are not desired.

16. The method of claim 12, wherein the exterior surface of the jacket is made of a metal or alloy.

17. The method of claim 12, having a conical nose segment and jacket and a rearward cylindrical portion.

18. The method of claim 12, wherein the projectile has a hemispherical tip and a rearward cylindrical portion.

* * * * *